United States Patent [19]

Gillen

[11] Patent Number: 4,535,948

[45] Date of Patent: Aug. 20, 1985

[54] DISPENSER

[76] Inventor: Mark Gillen, 675 Hudson St., New York, N.Y. 10014

[21] Appl. No.: 419,169

[22] Filed: Sep. 17, 1982

[51] Int. Cl.[3] ..... B65H 75/02

[52] U.S. Cl. ..... 242/55.2

[58] Field of Search ..... 211/16; 312/37; 242/55.2, 55.54, 68.4; D6/49; 248/229.1, 229.2

[56] References Cited

U.S. PATENT DOCUMENTS

| | | | |
|---|---|---|---|
| 112,004 | 2/1871 | Alsop | 211/16 |
| 1,098,863 | 6/1914 | Wheeler | 242/55.2 |
| 1,651,867 | 12/1927 | Boynton | 242/55.2 |
| 2,211,576 | 8/1940 | Moore | 242/55.2 |
| 2,518,328 | 8/1950 | Janonis | 242/55.2 |

FOREIGN PATENT DOCUMENTS

| | | | |
|---|---|---|---|
| 517706 | 10/1955 | Canada | 242/55.2 |
| 1077792 | 1/1965 | United Kingdom | 248/224.1 |

*Primary Examiner*—Stephen Marcus
*Assistant Examiner*—Leo J. Peters
*Attorney, Agent, or Firm*—Kane, Dalsimer, Kane, Sullivan & Kurucz

[57] ABSTRACT

A dispenser for a roll of product which includes two supporting arms oppositely positioned at the end of a substantially V-shaped base portion. The supporting arms are extended from the base portion to allow for proper dispensing in particular circumstances with the supporting arms including stability members to allow for effective dispensing when the frame is free standing along its horizontal or particularly its vertical axis.

2 Claims, 7 Drawing Figures

FIG. 5
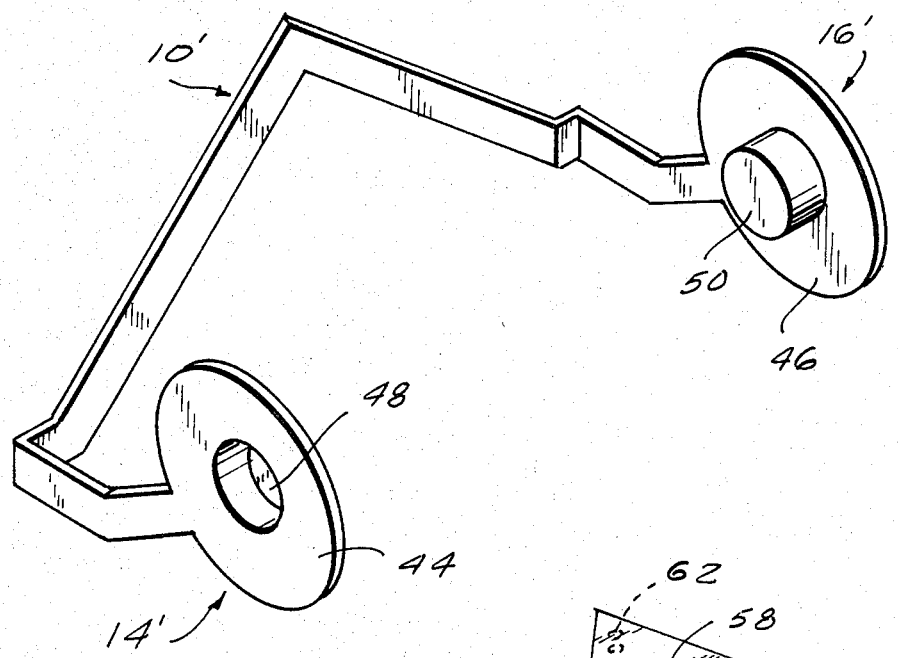
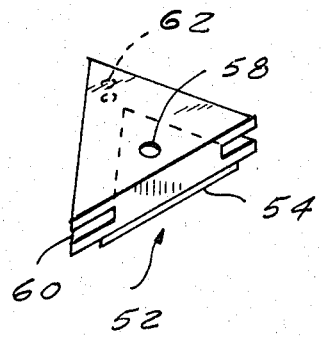
FIG. 6
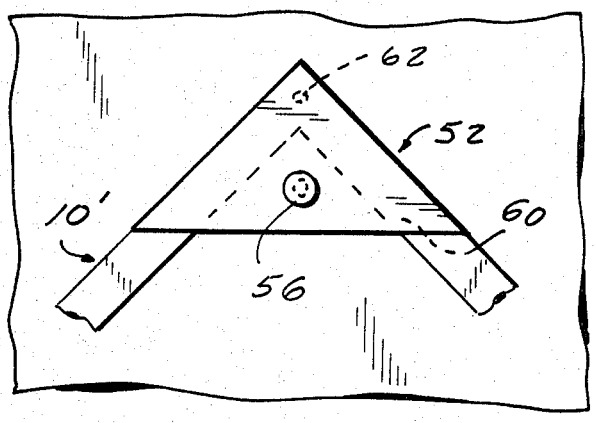
FIG. 7

DISPENSER

FIELD OF THE INVENTION

The present invention relates to a dispenser, particular one that allows for dispensing material from a rolled sheet such as paper towels etc.

BACKGROUND OF THE INVENTION

There presently exists many types of dispensers or holders for rolled material, such as paper, paper towels, plastic bags, etc. Many of the present designs are rather complicated for the function they serve often utilizing swinging arms, compressible roller bars etc., all adding to their ultimate manufacturing cost.

In addition, most present dispensers are designed to be fixedly mounted i.e., against a wall or under a shelf. In this regard, inevitably at least two fastening means are necessary to affix the dispenser to prevent its tilting and allow for proper operation. The need for two or more fasteners to affix the dispenser in certain circumstances is undesirable. Examples of this would be when the surface to which the dispenser is being attached it is difficult to drive a fastener into such as a concrete wall, metal shelf, ceramic tile, etc. Even if the surface is easy to penetrate, the need for two or more fasteners may be cumbersome for example where one fastener is driven into a beam in a wall, with another required to go into a dry wall thereby requiring an anchor, adding to the work and inconvenience involved.

Accordingly, there exists a need for a dispenser which is relatively simple and inexpensive in design and manufacture but effective in allowing the dispensing of the product contained thereon. There also exists a need for a dispenser which does not require complicated or unnecessary procedures and material for affixing it to the desired surface but rather is readily and quickly attached.

Further, many times it is desirable to have a dispenser which does not require actual fastening to a particular surface, but is portable or free standing in a variety of positions or removably supportable by a shelf, back of a chair, door knob etc. Heretofore, in Canadian Patent 517,706 issued Oct. 18, 1955, there is disclosed a paper towel holder which does not require its fastening to a wall or other surface to allow for dispensing of the roller material. However this holder is limited in the manner it can be supported to enable proper dispensing. If one were restricted to supporting such a holder by suspending it over a supporting surface such as the back of a chair or shelf etc., due to the proximity of the support arms to the cross member, once suspended, the roll of product would engage the supporting surface impeding the dispensing of product therefrom.

Furthermore, while not suggested by the Canadian patent, should one desire to affix this towel holder to a wall etc., it would clearly require at least two fasteners, suffering the disadvantage aforenoted.

SUMMARY OF THE INVENTION

Accordingly, it is a principal object of this invention to provide a dispenser which is relatively simple and inexpensive and readily affixable to a surface without unnecessary procedures or materials.

It is another object of this invention to provide for a versatile dispenser which may alternatively be portable in nature if so desired, and supported in a myriad of positions for convenient yet effective dispensing therefrom.

The present invention in this regard provides for a single piece dispenser adapted to maintain a roll of product to be dispensed between two supporting arms oppositely positioned at the ends of a V-shaped base portion which may be affixed to a surface via a single fastener or clipping means. The supporting arms are extended from the base portion to allow for proper dispensing when the dispenser is used in a portable manner, i.e., suspended on the back of a chair, door knob etc., and may include stability members to allow for effective dispensing when the dispenser is free standing along its horizontal or particularly its vertical axis.

BRIEF DESCRIPTION OF THE DRAWINGS

These and other objects and advantages will be realized by the present invention, the description of which should be taken in conjunction with the drawings wherein:

FIG. 4 is a side elevational partially phantom view of the dispenser suspended over the back of a chair or the like;

FIG. 5 is a perspective view of a second embodiment of the dispenser incorporating the teachings of the present invention;

FIG. 6 is a perspective partially phantom view of a clip member incorporating the teachings of the present invention; and FIG. 7 is a partial view showing the clip member in combination with the dispenser shown in FIG. 5.

DETAILED DESCRIPTION OF THE PREFERRED EMBODIMENT

Figure 1:
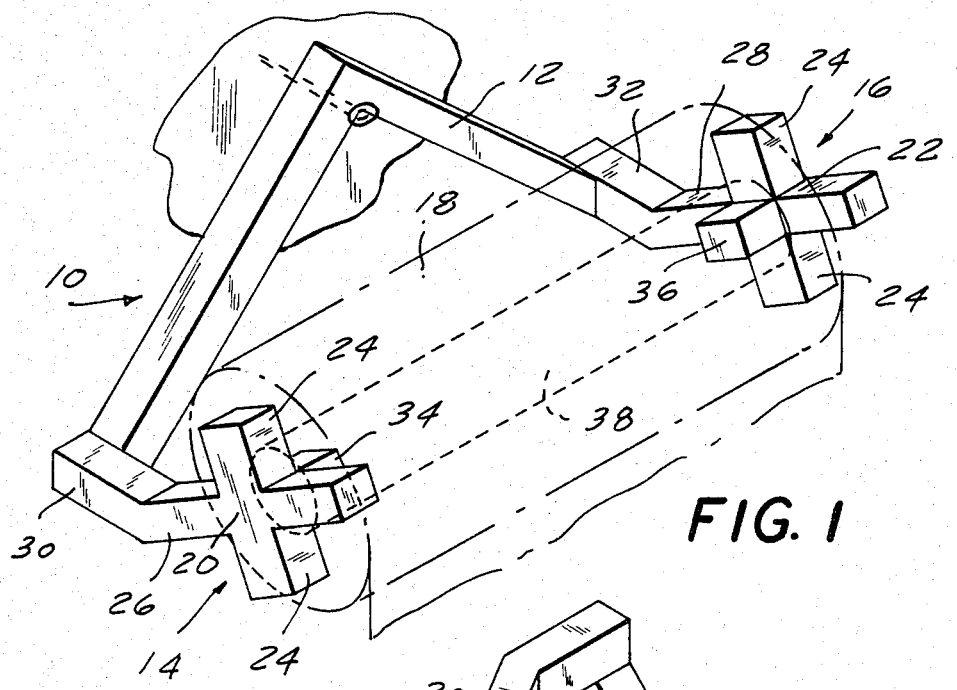
FIG. 1 is a perspective partially phantom view of a dispenser with product suitably affixed to a surface, incorporating the teachings of the present invention.

With reference now more particularly to FIGS. 1–4, there is shown a dispenser 10 which includes a symmetrical V-shaped base portion or cross member 12 having at its ends similarly shaped support arms 14 and 16 which are oppositely spaced and adapted to rotatably maintain a rolled product (in phantom) 18 therebetween. As shown in FIG. 1, such a V-shaped arrangement advantageously allows for the affixing of the dispenser 10 by a single fastener positioned at the junction of the arms of the V, with the base portion supported by its resting thereon or with the fastener therethrough. Alternatively, the dispenser 10 may be used portably with the cross member perhaps slipped over a door knob or other supporting element or the like. Further, the dispenser 10 may be left free standing in this position if so desired.

Note that with regard to the product 18, it may take on a variety of forms of which paper towel and plastic bag rolls are probably most familiar. However, the type of rolled product being dispensed is by no means critical to the invention, aside from its ability to rotate in the dispenser.

The support arms 14 and 16 may be formed with respective X-shaped members 20 and 22 having perpendicular legs or stability members 24 and elongated legs 26 and 28 which are angularly coupled to respective extension members 30 and 32 if so desired. Disposed on the portion of the arms 14 and 16 facing each other and centered with respect to the X-shaped member are inwardly protruding nipples 34 and 36. These nipples serve directly to support the rolled product 18 by their insertion into the tubular roll 36 about which the product is rolled and are of a sufficient length to maintain the roll therein. It might be noted that while the two arm and nipple arrangement described is particularly advantageous for reasons that are apparent, other types of supporting means, such as that shown in FIG. 5 as hereinafter discussed or perhaps i.e., a single arm having an elongated nipple and coupled with the V-shaped base portion, may also be utilized to incorporate the advantages provided by the base portion previously discussed.

Figure 2:
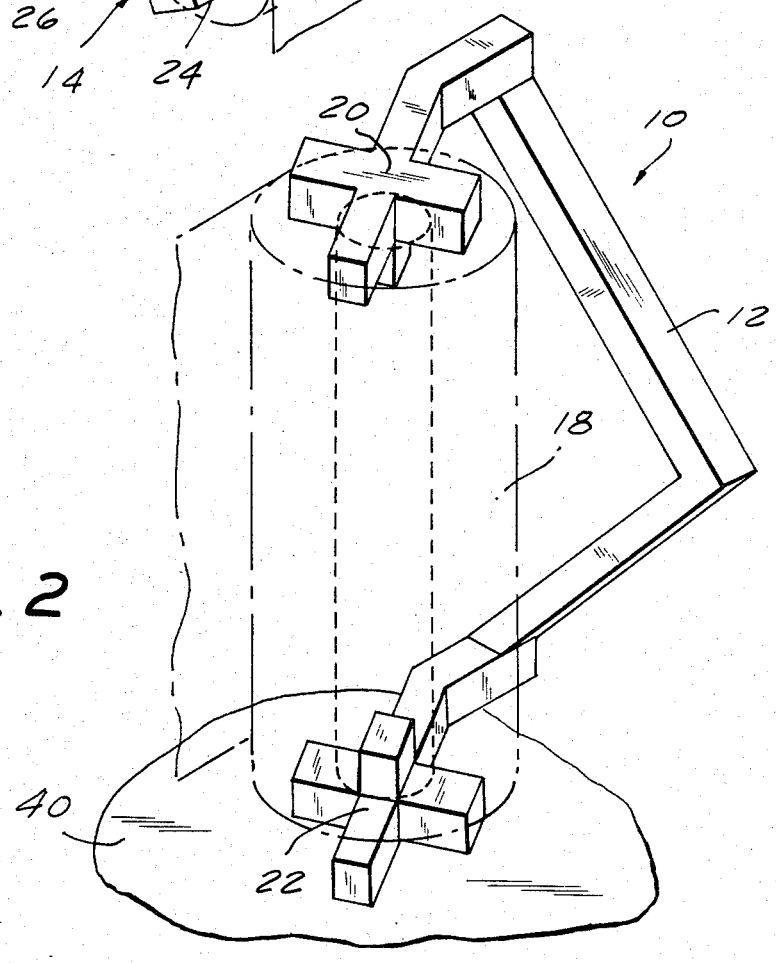
FIG. 2 is a perspective partially phantom view of the dispenser along its vertical axis by its resting on a suitable surface.

The opposite sides of the respective arms 14 and 16 are flat so as to enable the dispenser to be advantageously supported by a suitable surface 40 along its vertical axis by either arm as shown in FIG. 2, maintaining the rolled product 18 in position for dispensing.

Note, the rolled product 18 is placed in and removed from the dispenser 10 by slightly separating the arms to accomodate the tubular roll 38 and when released will spring back into position. Accordingly, the dispenser 10 should be sufficiently flexible to accommodate such movement.

The dispenser 10 may be constructed as a single piece of plastic, wood, metal or any other material suitable for purpose. While square cross section parts of the dispenser 10 are shown in FIGS. 1–4, in FIG. 5 another embodiment having a somewhat thinner or reduced cross section is used. Accordingly, it should be understood that the shape in this regard may vary within the teachings of the invention.

Figure 3:
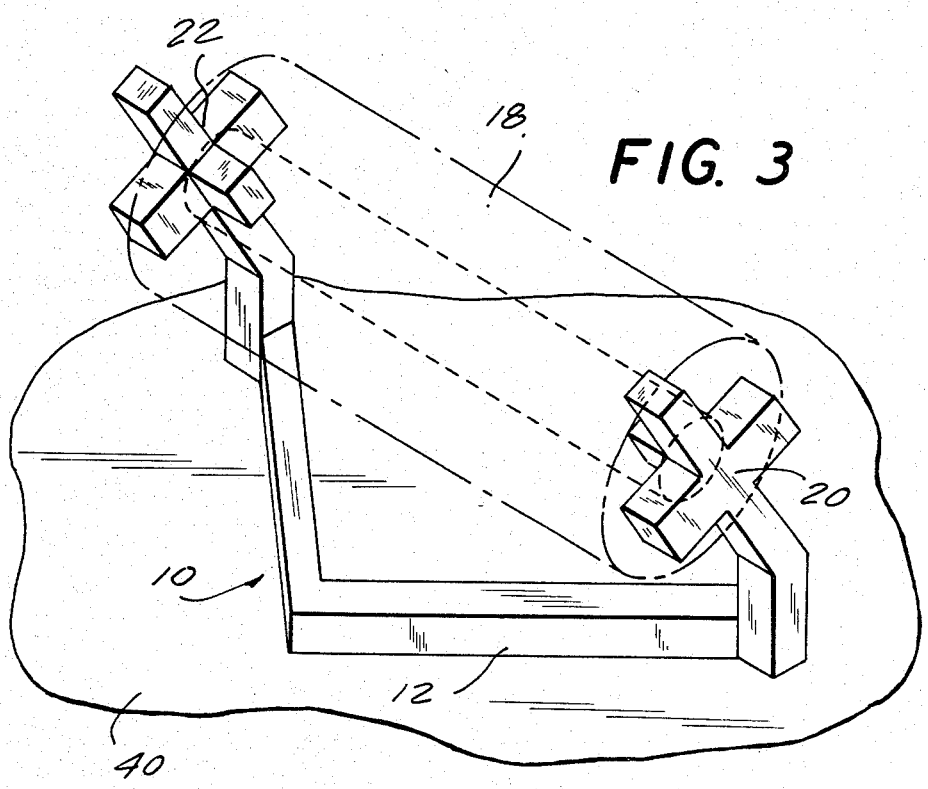
FIG. 3 is a perspective partially phantom view of the dispenser supported along its horizontal axis by its resting on a suitable surface.
Figure 4:
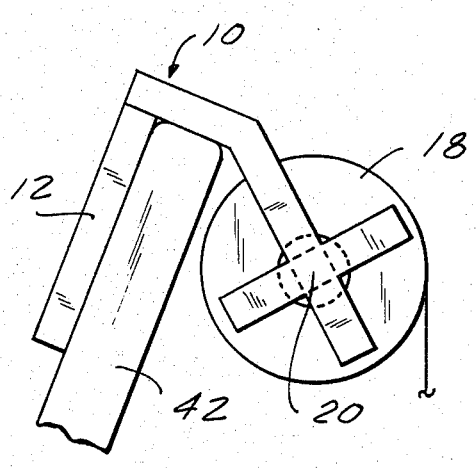

Turning now to FIG. 3, the dispenser 10 is shown in another position for dispensing by the resting of base portion 12 on a suitable surface 40 along its horizontal axis. In this regard, it is preferable that the side of the base portion contacting the surface is flat so as to provide even support thereto. In FIG. 4, the dispenser 10 is shown in a different position supported by a back of a chair 42 (partially shown) or the like. As is readily apparent, the extension members 30 and 32 serve to allow the rolled product 18 to be mounted away from the base portion 12 and accordingly the chair back, to allow improved operation of the device. Note that similar to the chair back 42 arrangement, the dispenser 10 may also be advantageously slipped over a shelf etc., or alternatively, fixedly mounted thereunder in a manner as aforenoted.

Turning now to FIG. 5 there is shown another preferred embodiment of the present invention and like parts similar to the previous embodiment will be similarly numbered but designated with a prime. Note that the advantages heretofore described with regard to the previous embodiment apply equally to this structure and therefore will not be repeated.

Dispenser 10′ is different from the previous embodiment in several respects. Firstly, the cross sectional area of the dispenser 10′ is thinner or reduced. Also, the supporting arms 14′ and 16′ include flat circular members 44 and 46 respectively having oppositely facing, inwardly protruding hollowed nipples 48 and 50 which serve to support a rolled tubular product.

The dispenser 10′ is capable of being both portable and fixed in a manner as aforenoted with regard to the first embodiment. Note however with regard to FIGS. 6 and 7, a triangular shaped clip member 52 may also be used in fixing the dispenser to a surface but especially in a hard to reach area such as under a shelf etc. In this regard, the clip 52 may be temporarily attached to the surface via a tape or adhesive 54 which is positioned on one of its sides. A fastener 56 may thereafter be affixed to the surface via a hole 58 in the clip 52. A V-shaped slot 60 is provided in clip 52 having a depth approximately equal to the cross sectional area at the apex of the V in the cross member 12′. This allows for the clip 52 to be first affixed to the surface with the dispenser then said into slot 60 thereby affixing the dispenser to the surface, as shown in FIG. 7. Note that a stopper 62 formed from a raised dimple may be provided in slot 60 to provide a snap-fit of the dispenser in the slot 62 or otherwise provide biasing therebetween, if so desired.

Thus by the present invention, the aforenoted objects and advantages are realized and although preferred embodiments have been disclosed and described in detail herein, its scope should not be limited thereby rather its scope should be determined by that of the appended claims.

What is claimed is:

1. A single piece dispenser for use in a dispensably holding roll of product maintained on a tubular roll, said dispenser comprising:

base portion formed in a substantially V-shaped configuration to alternatively be effectively fastened to a surface by a single fastener, removably and evenly supported on its base portion by a flat surface such as shelf, chair back, door knob or the like;

supporting means which includes two similarly shaped supporting arms oppositely disposed with respect to each other and respectively coupled at one end to respective ends of the base portion, said supporting arms extend outward and upwardly away from said base portion and legs attached to a respective distal end opposite said one end of said supporting arms and disposed at an angle with the respective arms to form a flat member perpendicular to the plane of said base portion of sufficient area to support said dispenser on a surface when said dispenser is rested on said surface with said flat member providing the contacting area with said surfaces;

means engageable with the tubular rolls respective ends, said engageable means comprising two oppositely disposed axially aligned nipples positioned on said respective flat members, said nipples being of a diameter slightly smaller than the diameter of the tubular roll, said dispenser being sufficiently flexible to allow the nipples to be inserted in respective ends of the tubular roll and allow the roll to axially rotate thereabout and said nipples being so positioned that a tubular roll maintained thereby is disposed parallel to the plane of the base position; and extension members coupled between said supporting arms and respective ends of the base portion, said extension members being disposed substantially perpendicular to the base portion's plane and of sufficient length so as to maintain said tubular roll at a predetermined distance from said base portion.

2. A single piece dispenser for use in dispensably holding roll of product maintained on a tubular roll, said dispenser comprising:

base portion formed in a substantially V-shaped configuration to alternatively be effectively fastened to a surface by a single fastener removably and evenly supported on its base portion by a flat surface, suspended from a suitable surface such as shelf, chair back, door knob or the like;

supporting means which includes two similarly shaped supporting arms oppositely disposed with respect to each other and respectively coupled at one end to respective ends of the base portion, said supporting arms extend outward and upwardly away from said base portion and legs attached substantially perpendicularly to a respective distal end opposite said one end of said supporting arms to form a cross therewith, said cross being disposed in a plane perpendicular to the plane of said base portion and having a sufficient area to suport said dispenser;

means engageable with the tubular rolls respective ends, said engageable means comprising two oppositely disposed axially aligned nipples positioned on said respectively crosses, said nipples being of a diameter slightly smaller than the diameter of the tubular roll, said dispenser being sufficiently flexible to alow the nipple to be separated so as to allow the nipples to be inserted in respective ends of the tubular roll and allow the roll to axially rotate thereabout and said nipples being so positioned that a tubular roll maintained thereabout and said nipples being so positioned that a tubular roll maintained thereby is disposed parallel to the plane of the base position; and extension members coupled between said supporting arms and respective ends of the base portion, said extension members being disposed substantially perpendicular to the base portion's plane and of sufficient length so as to maintain said tubular roll at a predetermined distance from said base portion.

* * * * *

UNITED STATES PATENT AND TRADEMARK OFFICE

CERTIFICATE OF CORRECTION

PATENT NO. : 4,535,948

DATED : August 20, 1985

INVENTOR(S) : Mark Gillen

It is certified that error appears in the above-identified patent and that said Letters Patent is hereby corrected as shown below:

Column 1, line 6, "particular" should read --particularly--

Column 6, line 2, "respectively" should read --respective--.

Signed and Sealed this

*Twentieth* Day of *May 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,535,948

DATED : August 20, 1985

INVENTOR(S) : Gillen

It is certified that error appears in the above-identified patent and that said Letters Patent are hereby corrected as shown below:

Column 1, Line 10, "exists" should be --exist--;

Column 4, Line 54, after "nipples" insert --to be separated so as--;

Column 4, Line 58, "position" should be --portion--;

Column 6, Line 5, "alow" should be --allow--.

Signed and Sealed this

Sixteenth Day of December, 1986

*Attest:*

DONALD J. QUIGG

*Attesting Officer*

*Commissioner of Patents and Trademarks*